US012017112B2

(12) United States Patent
Keeney

(10) Patent No.: US 12,017,112 B2
(45) Date of Patent: Jun. 25, 2024

(54) AGILITY LADDER PROJECTION SYSTEMS, DEVICES, AND METHODS

(71) Applicant: John S. Keeney, Tustin, CA (US)

(72) Inventor: John S. Keeney, Tustin, CA (US)

( * ) Notice: Subject to any disclaimer, the term of this patent is extended or adjusted under 35 U.S.C. 154(b) by 377 days.

(21) Appl. No.: 17/193,634

(22) Filed: Mar. 5, 2021

(65) Prior Publication Data

US 2022/0280834 A1 Sep. 8, 2022

(51) Int. Cl.

| | |
|---|---|
| ***A63B 23/04*** | (2006.01) |
| ***A63B 22/00*** | (2006.01) |
| ***A63B 24/00*** | (2006.01) |

(52) U.S. Cl.

CPC ..... *A63B 23/0464* (2013.01); *A63B 24/0075* (2013.01); *A63B 2022/0092* (2013.01); *A63B 2024/004* (2013.01)

(58) Field of Classification Search

CPC ..... A63B 23/0464; A63B 24/0075; A63B 2022/0092; A63B 2024/004

See application file for complete search history.

(56) References Cited

U.S. PATENT DOCUMENTS

| | | | | |
|---|---|---|---|---|
| 5,976,039 | A | 11/1999 | Epel et al. | |
| 7,219,438 | B2 | 5/2007 | Amron et al. | |
| 7,866,052 | B2 | 1/2011 | Schulze | |
| 8,282,481 | B2 * | 10/2012 | Yun | G09B 19/0038 463/32 |
| 9,501,140 | B2 | 11/2016 | Nahon et al. | |
| 2007/0055562 | A1 | 3/2007 | Kralik | |
| 2007/0219024 | A1 | 9/2007 | Allegre | |

(Continued)

FOREIGN PATENT DOCUMENTS

| | | | | |
|---|---|---|---|---|
| EP | 3281754 A1 * | 2/2018 | ..... | B26B 3/00 |
| KR | 20190130761 A * | 11/2019 | ..... | G06V 40/23 |
| WO | WO-2017217725 A1 * | 12/2017 | ..... | G06F 3/01 |

OTHER PUBLICATIONS

Kazuki Lida et al., "AirTiles: Modular Devices to Create a Flexible Sensing Space", SIGGRAPH '10 ACM SIGGRAPH 2010, Emerging Technologies, Jul. 2010, Article No. 5, p. 1, https://doi.org/10.1145/1836821.1836826.

(Continued)

*Primary Examiner* — Sundhara M Ganesan
*Assistant Examiner* — Jacqueline N L Loberiza
(74) *Attorney, Agent, or Firm* — Rutan & Tucker LLP; Ravi Mohan

(57) ABSTRACT

Systems, devices, and methods for projecting an agility ladder onto a ground surface. A device may include a light source and an optical element configured to include an image of the agility ladder having a plurality of adjacent enclosed zones. The optical element may be positioned to allow the light source to project light through the optical element. The device may include at least one optical lens positioned such that the optical element is between the light source and the at least one optical lens. The at least one optical lens may be configured to magnify and project the image onto the ground surface. The device may include a plurality of sensors configured to detect an appendage partially or completely stepped within each of the plurality of adjacent enclosed zones. The device may include a processor coupled to the sensors and programmed to determine one or more training metrics.

19 Claims, 6 Drawing Sheets

(56) References Cited

U.S. PATENT DOCUMENTS

| | | | | |
|---|---|---|---|---|
| 2014/0171234 | A1 | 6/2014 | Vogt | |
| 2020/0393442 | A1* | 12/2020 | Hall | A47K 17/028 |

OTHER PUBLICATIONS

Boonim et al., "Athletes Performance Evaluation by Automated Ladder for Speed and Agility", 2018 15th International Conference on Electrical Engineering/Electronics Computer, Telecommunications and Information Technology (ECTI-CON), Jul. 18, 2018.

Lei et al., "The validity of using reality head mounted display for agility training", ISBS Proceedings Archive 36.1 (2018): 122, 2018.

* cited by examiner

AGILITY LADDER PROJECTION SYSTEMS, DEVICES, AND METHODS

1. FIELD

The present disclosure relates to systems, devices, and methods for projecting an agility ladder onto a ground surface to be used in physical exercise, drills, and training.

2. DESCRIPTION OF THE RELATED ART

Agility ladders are widely used to perform a broad range of movements or exercises to improve physical fitness, including strength, coordination, speed, reaction time, endurance, calorie burn, and cardiovascular health. Agility ladders are commonplace in various settings of physical activity, including gyms, sports conditioning, physical therapy, rehabilitation, and military drills. Trainees or users may move through each zone of the ladder via one or more appendage (e.g., one or both feet and/or one or both hands). Types of movement forms may include on both legs, single-legged, on one or both knees, handstand, and bear crawl positions. Agility ladder exercises may have different goals, such as keeping both appendages within the zones, moving appendages in and out of the zones, and stepping on the edges of the zones in a given lap.

Generally, agility ladders are laid out substantially straight on the ground to have even and symmetric zones while performing exercises. However, agility ladders may slip, move around, and lose their initial straight position when the appendages step on the edges as part of an exercise or by accident. As a result, the trainee may have a misstep and may have to pause training to restraighten the agility ladder. Additionally, agility ladders may occupy a large surface area when laid out that may not be suitable for limited spaces, such as home gyms, hotel rooms, or small workout studios. When folded, rolled, or bunched up to store when not in use, agility ladders may still take up considerable space and may be difficult to transport. Further, the trainees do not have the ability to self-monitor, track, or review key training metrics that demonstrate whether the trainees are successfully completing exercises as intended (e.g., stepping correctly, moving at or above a minimum speed goal, completing a goal number of laps) and whether they progress and improve their stats.

Thus, agility ladder projection systems, devices, and methods are needed.

SUMMARY

Systems, devices, and methods for projecting an agility ladder onto a ground surface to be used in physical exercise, drills, and training. The systems, devices, and methods may include a light source, an optical element that includes an image of the agility ladder, and one or more optical lenses to project the agility ladder onto the ground surface. The projection may be a laser projection where the light source may be configured to emit a laser beam. Alternately, the systems, devices, and methods may include a projector configured to project an image of the agility ladder stored in a memory. The systems, devices, and methods may include a plurality of sensors that detect an appendage when the appendage partially or completely steps within an enclosed zone of the agility ladder. A processor may determine one or more training metrics, including appendage ground contact time, appendage speed, number of laps completed, and/or stepping errors during training. The systems, devices, and methods may include an input device to control the systems and devices and an output device to output the one or more training metrics. The input device may be used to change dimensions, shape, and a number of enclosed zones of the agility ladder.

In accordance with an embodiment of the present disclosure, there may be a device for projecting an agility ladder onto a ground surface. The device may have a light source. The device may further have an optical element configured to include an image of the agility ladder. The agility ladder may have a plurality of enclosed zones. The optical element may be positioned to allow the light source to project the light through the optical element. The device may further have at least one optical lens. The at least one optical lens may be positioned such that the optical element is between the light source and the at least one optical lens. The at least one optical lens may be configured to magnify and project the image onto the ground surface to allow a user to perform agility ladder exercises. The device may further have a housing that assembles the light source, the optical element, and the at least one optical lens.

The device may further have a plurality of sensors configured to detect an appendage partially or completely stepped within each of the plurality of adjacent enclosed zones. The device may further have a processor coupled to the plurality of sensors. The processor may be programmed to determine one or more training metrics.

The plurality of sensors may include an infrared (IR) laser diode configured to detect motion over the projected image. The plurality of sensors may further include a camera configured to capture an incoming IR laser diode beam angle. The plurality of sensors may further include a metal-oxide-semiconductor field-effect-transistor (MOSFET) configured to process the incoming IR laser diode beam angle to image a position of the appendage step. The plurality of sensors may further include a sensor configured to determine the position of the appendage step.

The processor may be further programmed to communicate with an output device to output the one or more training metrics. The light source may be controllable by the output device. The light source may be configured to emit a laser beam.

Each of the plurality of enclosed zones may have a triangle, square, or hexagon shape. The device may further have a plurality of the optical element. Each of the plurality of the optical elements may be configured to include the image of the agility ladder having a different number of each of the plurality of adjacent enclosed zones. The number may be adjustable by selecting a desired one of the plurality of the optical elements to be positioned to allow the light source to project the light through the desired one of the plurality of the optical elements. The at least one optical lens may have adjustable magnification to adjust dimensions of each of the plurality of adjacent enclosed zones of the image of the agility ladder projected onto the ground surface.

In accordance with another embodiment of the present disclosure, there may be a projection agility ladder training system. The system may have a memory configured to store an image of the agility ladder. The agility ladder may be defined by a plurality of adjacent enclosed zones. The system may further have a projector coupled to the memory. The projector may be configured to project the image onto a ground surface. The system may further have a plurality of sensors configured to detect an appendage partially or completely stepped within each of the plurality of adjacent enclosed zones. The system may further have a processor coupled to the plurality of sensors. The processor may be programmed to determine one or more training metrics during agility ladder training. The system may further have a housing that assembles the memory, the projector, the plurality of sensors, and the processor.

The plurality of sensors may include an IR laser diode configured to detect motion over the projected image. The plurality of sensors may further include a camera configured to capture an incoming IR laser diode beam angle. The plurality of sensors may further include a MOSFET configured to process the incoming IR laser diode beam angle to image a position of the appendage step. The plurality of sensors may further include a sensor configured to determine the position of the appendage step.

The system may further have a user interface device. The user interface device may have an input device configured to receive user input corresponding to a request to begin projecting the image of the agility ladder, change dimensions of each of the plurality of enclosed zones, change a number of each of the plurality of enclosed zones, change a shape of each of the plurality of enclosed zones, or stop projecting the image. The input device may be further configured to receive user input corresponding to a request to begin, pause, or stop determining and recording the one or more training metrics. The user interface device may further have a mobile processor programmed to control the memory and the projector to execute the request based on the received user input. The mobile processor may be further programmed to control the plurality of sensors and the processor to execute the request based on the received user input.

In accordance with an embodiment of the present disclosure, there may be a method for providing agility ladder training to a user. The method may include producing, by a light source, light. The method may further include magnifying, by at least one optical lens, an image of the agility ladder located on an optical element. The agility ladder may have a plurality of adjacent enclosed zones. The optical element may be positioned to allow the light to pass through the optical element. The method may further include projecting, by the at least one optical lens, the magnified image onto a ground surface. The method may further include detecting, by a plurality of sensors, an appendage of the user partially or completely stepped within each square of the plurality of squares. The method may further include determining, by a processor, one or more training metrics during agility ladder training. The method may further include displaying, by an output device, the one or more training metrics. The light source, the optical element, the at least one optical lens, the plurality of sensors, and the processor may be assembled by a housing.

The method may further include receiving, by an input device of a user interface device, user input corresponding to a request to begin projecting the image of the agility ladder, change dimensions of each of the plurality of enclosed zones, change a number of each of the plurality of enclosed zones, change a shape of each of the plurality of enclosed zones, or stop projecting the image. The method may further include controlling, by a mobile processor of the user interface, the light source, the optical element, and the at least one optical lens to execute the request based on the received user input. The method may further include receiving, by the input device, user input corresponding to a request to begin, pause, or stop determining and recording the one or more training metrics. The method may further include controlling, by the mobile processor, the plurality of sensors and the processor to execute the request based on the received user input.

BRIEF DESCRIPTION OF THE DRAWINGS

Other systems, methods, features, and advantages of the present disclosure will be apparent to one skilled in the art upon examination of the following figures and detailed description. Component parts shown in the drawings are not necessarily to scale and may be exaggerated to better illustrate the important features of the present disclosure.

DETAILED DESCRIPTION

The systems, devices, and methods described herein project an agility ladder onto a ground surface to be used in physical exercise, drills, and training. The systems, devices, and methods may include a light source, an optical element that includes an image of the agility ladder, and one or more optical lenses to advantageously project the agility ladder onto the ground surface. The projection may be a laser projection where the light source may be configured to emit a laser beam. Alternately, the systems, devices, and methods may include a projector configured to project an image of the agility ladder stored in a memory. The systems, devices, and methods may include a plurality of sensors that advantageously detect an appendage when the appendage partially or completely steps within an enclosed zone of the agility ladder. A processor may determine training metrics including but not limited to appendage ground contact time, appendage speed, number of laps completed, and/or stepping errors during training. The systems, devices, and methods may include an input device to control the systems and devices and an output device to advantageously output the training metrics. A number of enclosed zones, dimensions of the enclosed zones, and shape of the enclosed zones may be advantageously adjustable by the input device.

Figure 1A:
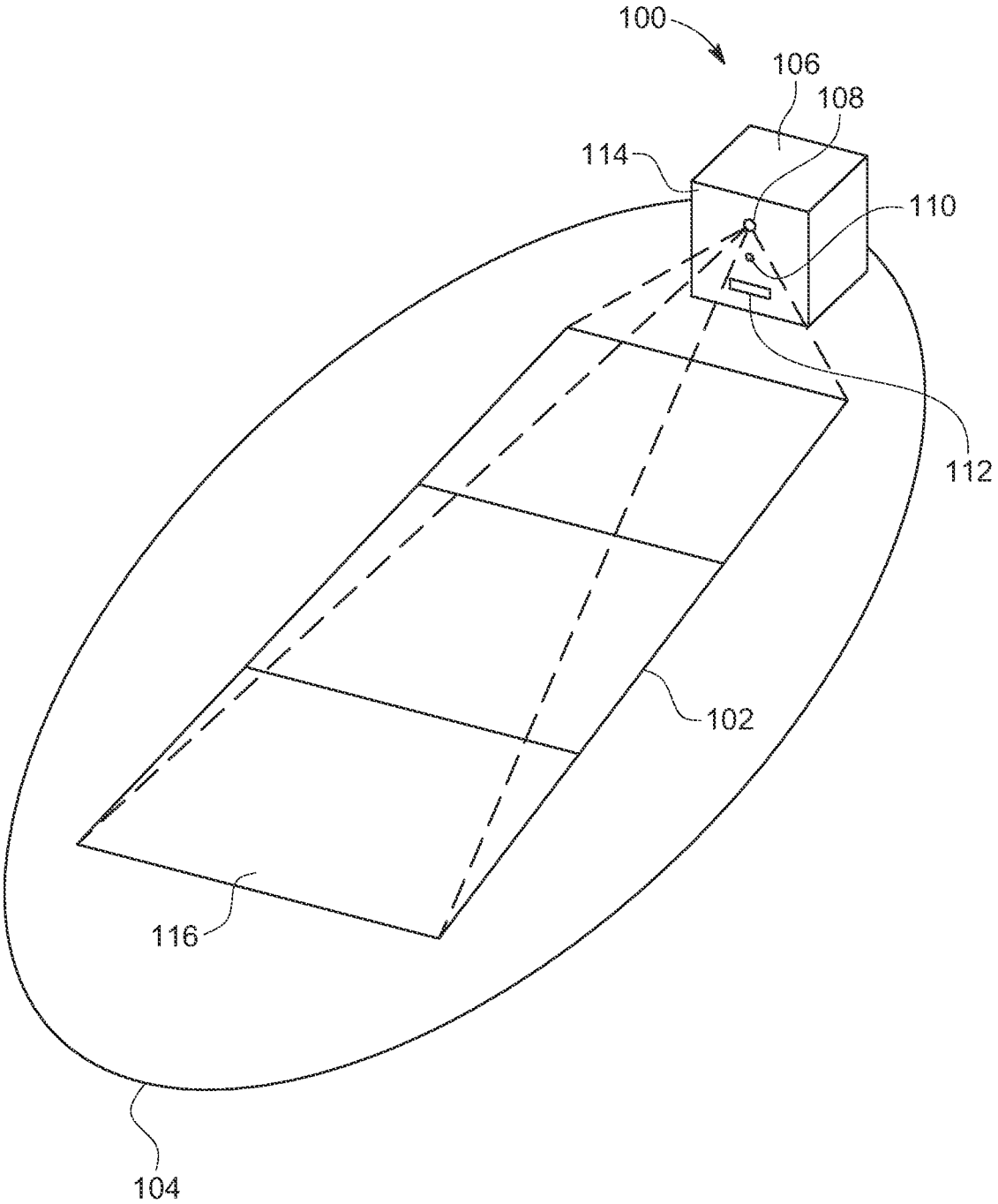
FIG. 1A illustrates a perspective view of an agility ladder projection device projecting an agility ladder vertically onto a ground surface according to an aspect of the current disclosure.

FIG. 1A illustrates a perspective view of an agility ladder projection device 100 projecting an agility ladder 102 vertically onto a ground surface 104 according to an aspect of the current disclosure. The ground surface 104 may be any surface where light can be reflected on. The ground surface 104 may be smooth (e.g., vinyl, linoleum, wood) or rough (e.g., grass, turf, rubber). The projection device 100 may have components assembled in a housing 106. The housing 106 may be plastic, wood, metal, glass, and/or the like. The housing 106 may be shaped and sized to be transportable. In some embodiments, the housing 106 may be pocket sized. The housing 106 may be shaped to stay upright when placed on the ground surface 104. In some embodiments, the housing 106 may have one or more legs to stand on. The housing 106 may have one or more openings or transparent or translucent sections that allow light to pass through. Such sections may be glass, acrylic, and/or the like. As shown in FIG. 1A, the device 100 may include at least one optical lens 108, an infrared (IR) filter 110, and a window 112 for IR light to pass through. The optical lens 108, the IR filter 110 and the window 112 may be on a front surface 114 of the housing 106. In some embodiments, in lieu of the housing 106, the projection device 100 may be integrated into an exercise equipment such as cable machines, cardio equipment (e.g., treadmill, exercise bike, StairMaster), and smart home gyms.

Figure 5A:
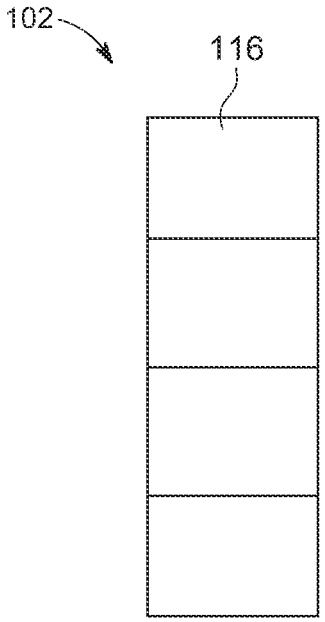
FIG. 5A illustrates an agility ladder projection having square shaped enclosed zones according to an aspect of the current disclosure.
Figure 5B:
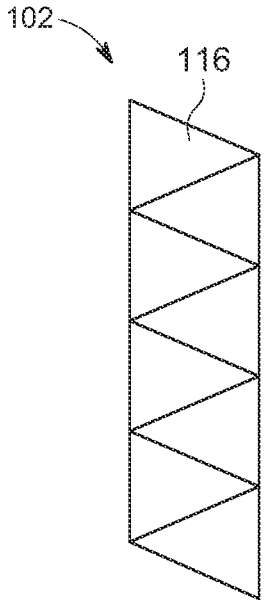
FIG. 5B illustrates an agility ladder projection having triangle shaped enclosed zones according to an aspect of the current disclosure.
Figure 5C:
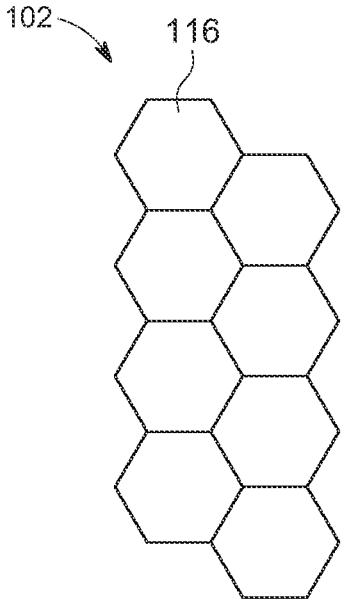
FIG. 5C illustrates an agility ladder projection having hexagon shaped enclosed zones according to an aspect of the current disclosure.

The optical lens 108 may magnify and project the agility ladder 102 onto the ground surface 104. The projection may be a laser projection or a lamp projection. The agility ladder 102 may have one or more enclosed zones 116. The enclosed zones 116 may be adjacent. A user may step completely or partially (i.e., edges and corners) within the enclosed zones 116 to exercise using the agility ladder 102. The enclosed zones 116 may have adjustable shapes. The shape of each of the enclosed zones 116 may be uniform. In some embodiments, the shape of each of the enclosed zones 116 may be different. Each enclosed zone 116 may be a polygon or an arcuate shape. By example and not limitation, the enclosed zones 116 may be square, triangular, or hexagonal as shown in FIGS. 5A-5C, respectively. The shape may be irregular. The user may draw and/or customize the shape via an input device. The enclosed zones 116 may have adjustable dimensions. The dimensions of the enclosed zones 116 may be changed by changing the magnification of the optical lens 108. If individual adjustment of the dimensions of the enclosed zones 116 is desired, the dimensions may be changed by changing the ratio of the enclosed zones 116 to each other on the image of the agility ladder 102 (i.e., the optical element or the image stored in the memory). In some embodiments, the color of the agility ladder 102 may be adjusted (e.g., changing the color of a laser diode, rotating a color wheel of the projector). Each of the enclosed zones 116 may have different border or fill colors. The color of each enclosed zone 116 may change based on predetermined objectives of an exercise and/or the user's location. For example, the enclosed zone 116 the user is supposed to step on next as part of an exercise may be indicated with a different color. In another example, if the user correctly or incorrectly steps on an enclosed zone 116, the enclosed zone 116 may change color (e.g., green for a correct step, red for an incorrect step). In some embodiments, the projection of the agility ladder 102 may have a changeable theme stored in a memory 132 (see FIG. 3B) or by changing the optical element 122 (see FIG. 3A). For example, the device 100 may project the agility ladder 102 along with colors and/or logos of a sports theme, a high school, a university, a brand, etc. In another example, the device 100 may project the agility ladder 102 with artistic visuals where the borders of the enclosed zones 116 are shaped like bamboo, grass, wood, marble, bone, etc.

Figure 1B:
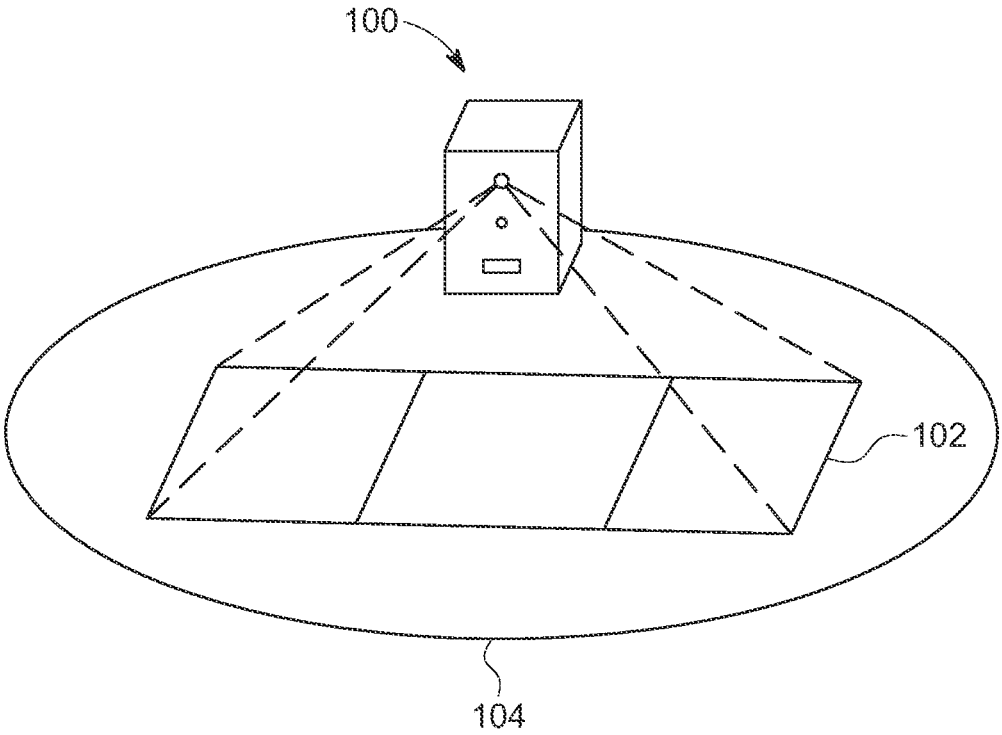
FIG. 1B illustrates a perspective view of an agility ladder projection device projecting an agility ladder horizontally onto a ground surface according to an aspect of the current disclosure.

FIG. 1B illustrates a perspective view of an agility ladder projection device 100 projecting an agility ladder 102 horizontally onto a ground surface 104 according to an aspect of the current disclosure. The agility ladder projection device 100 may be the agility projection device 100 of FIG. 1A configured to project the agility ladder 102 horizontally. Configuration of the agility ladder projection device may be changed between a horizontal projection and a vertical projection. The projection orientation may be changed by selecting an image of the agility ladder 102 having a desired orientation stored in a memory 132 (see FIG. 3B) or by changing the optical element 122 (see FIG. 3A). In some embodiments, the agility ladder projection device 100 may have the same specifications and capabilities of the agility projection device 100 of FIG. 1A, except permanently configured to project the agility ladder 102 with a horizontal orientation. The horizontal orientation and the vertical orientation of the agility ladder 102 with respect to the agility ladder projection device 100 each may allow the user to perform orientation specific exercises without knocking over the agility ladder projection device 100.

Figure 2A:
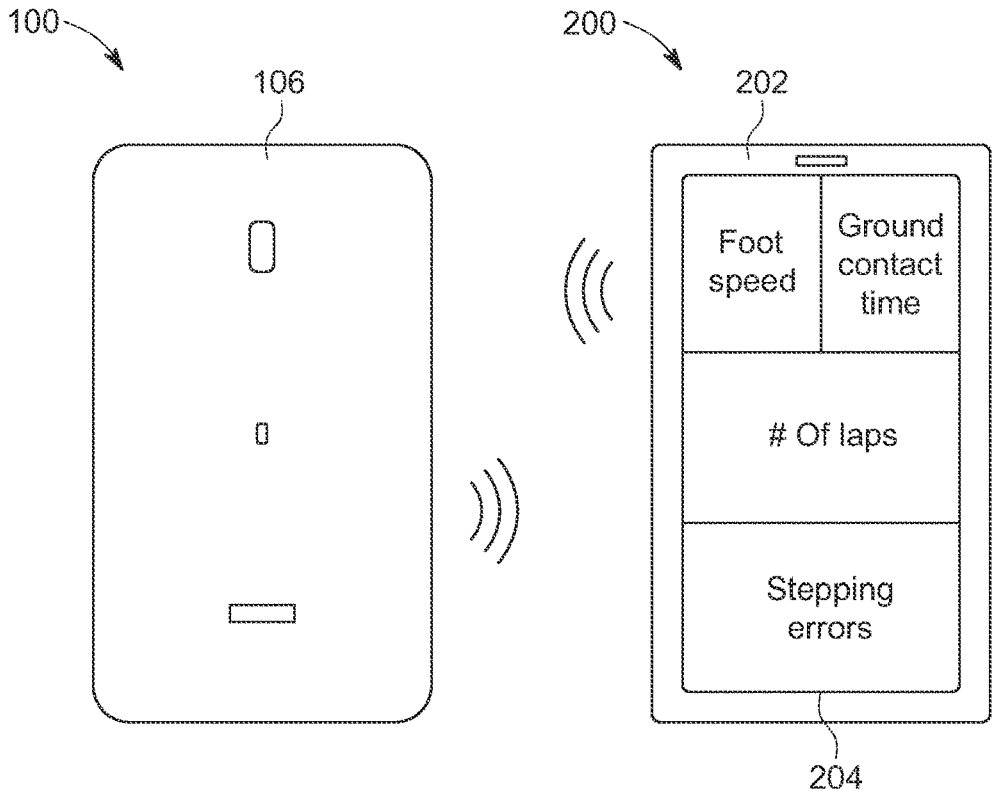
FIG. 2A illustrates an agility ladder projection device communicating with a remote input/output device according to an aspect of the current disclosure.

FIG. 2A illustrates the agility ladder projection device 100 communicating with a remote input/output device 200 according to an aspect of the current disclosure. The remote device 200 may be a mobile phone, tablet, laptop, handheld gaming console, a smartwatch, or another portable computing device. The projection device 100 may be connected via a wired or a wireless connection to the remote device 200. For example, the wired connection may be via any type of Universal Serial Bus (USB) or a lighting connection. In another example, the wireless connection may be Bluetooth, Infrared, WiFi, and the like. The wireless communication may be received by a wireless sensor 206 (see FIG. 2B) of the remote device 200. The device 200 may have an input receiver 202 such as a touchscreen, buttons, knobs, dials, and/or a microphone. The user may control the projection device 100 by inputting a command (e.g., pressing a button, speaking) via the input receiver 202. For example, the user may turn on/off the projection device 100, start/end a workout, and adjust the dimensions, color, shape, and/or the number of enclosed zones 116 (see FIGS. 1A-1B). The device 200 may further have an output transmitter 204 (e.g., a display, speakers). The user may view and/or hear the projection device 100 setting options and training metrics measured during agility ladder training, including appendage speed, ground contact time, number of laps completed, and stepping errors. In some embodiments, in lieu of a remote device 200, the projection device 100 may have a native input device (e.g., a touchscreen, buttons, knobs, dials, a microphone) and/or a native output device (e.g., a display, speakers). The native input device and output device may be located on the housing 106.

Figure 2B:
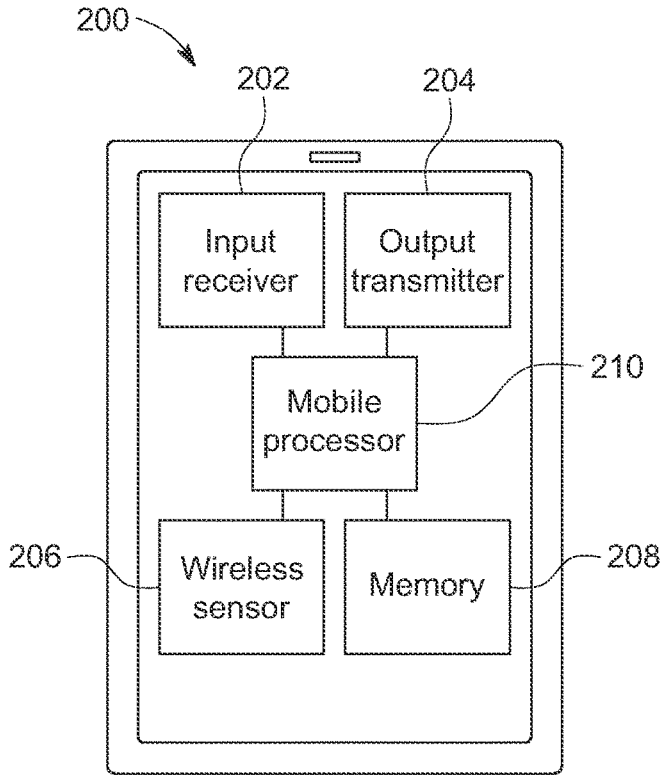
FIG. 2B is a block diagram illustrating various components of the remote input/output device of FIG. 2A according to an aspect of the current disclosure.

FIG. 2B is a block diagram illustrating various components of the remote input/output device 200 according to an aspect of the current disclosure. The remote device 200 may have the input receiver 202, the output transmitter 204, the wireless sensor 206, a memory 208, and a mobile processor 210. The input receiver 202, the output transmitter 204, the wireless sensor 206, and the memory 208 may be connected to the mobile processor 210. The wireless sensor 206 may be configured to receive a wireless signal (e.g., Bluetooth, Infrared, WiFi). The mobile processor 210 may be programmed to process and execute the input received by the input receiver 202, process the metrics data received by the wireless sensor 206 or a wired connection, transmit user commands received by the input receiver 202 to the projection device 100 via the wireless sensor 206, command the memory 208 to store the metrics data and chosen user settings, and command the output transmitter 204 to display a user interface and the metrics data. The memory 208 may be a random-access memory (RAM), a disk, a flash memory, an optical disk drive, hybrid memory, or any other storage medium that can store data. The memory 208 may store program code that are executable by the mobile processor 210. The memory 208 may store data in an encrypted or any other suitable secure form.

Figure 3A:
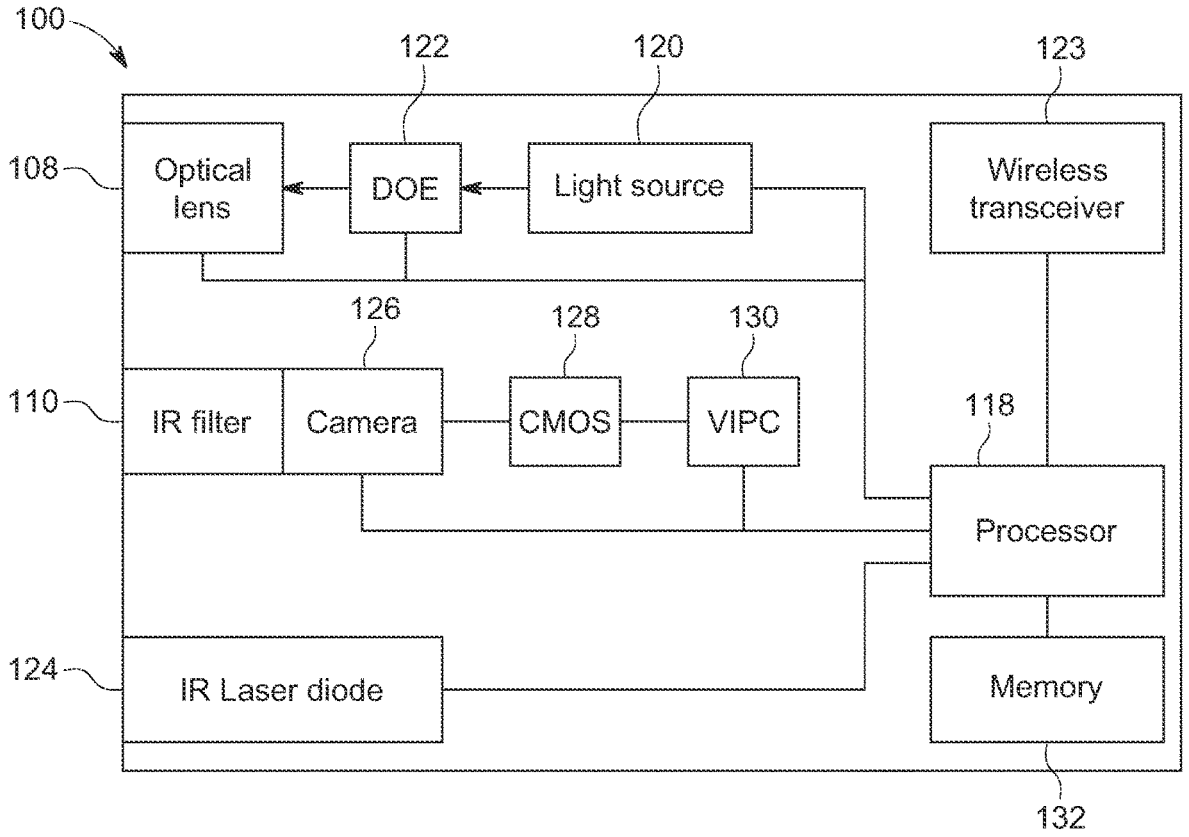
FIG. 3A is a block diagram illustrating various components of an agility ladder projection device according to an aspect of the current disclosure.

FIG. 3A is a block diagram illustrating various components of the agility ladder projection device 100 according to an aspect of the current disclosure. The projection device 100 may have one or more processors 118. The one or more processors 118 may be one or more integrated circuits configured to control and manage the operation of the projection device 100. Only one processor 118 is shown in FIG. 3A by example. The processor 118 may be configured to execute machine-readable instructions. The processor 118 may be a microprocessor or microcontroller by example. The processor 118 may be coupled to a light source 120, an optical element (a diffractive optical element (DOE) is shown by example) 122, a wireless transceiver 123, and a plurality of sensors. The plurality of sensors may include an IR laser diode 124, a camera 126, a MOSFET (a complementary metal-oxide-semiconductor (CMOS) 128 is shown by example), and a sensor or a chip (a virtual interface processing core (VIPC) is shown by example) 130 configured to determine the position of the appendage step.

The light source 120 may be a laser diode. The laser diode may emit light. The light may be different colors. In some embodiments, the light source 120 may be a lamp. The light may be directed towards the DOE 122. The DOE 122 may shape and split the light shining through the DOE. The DOE 122 may be an image of the agility ladder 102. The DOE 122 may be changed or switched to change the dimensions and/or the shape of the agility ladder 102 (see FIGS. 1A-1B) and/or the number of enclosed zones 116 (see FIGS. 1A-1B). For example, the DOE 122 may have a reel of images (see FIG. 4) of the agility ladder 102 having different dimensions, shape, or number of enclosed zones 116. The user may manually or automatically scroll through the reel to position a desired image of the agility ladder 102 on a path of the shining light. For example, the DOE 122 may be changed by the processor 118 based on user input received by the processor 118. The projection device 100 or one or more components of the projection device 100 may also be turned on and turned off via user input.

The user input may be received by an input such as a touchscreen, knobs, buttons, and the like on the housing 106 (see FIG. 2A). The user input may also be received via a wired or a wireless connection of an input device, for example the remote device 200 (see FIG. 2A). For example, the wired connection may be via any type of USB or a lighting connection. In another example, the wireless connection may be Bluetooth, Infrared, WiFi, and the like. The wireless communication may be received by the wireless transceiver 123.

The light having the shape of the agility ladder 102 may pass through the at least one optical lens 108. The at least one optical lens 108 may magnify the light having the shape of the agility ladder 102 and project it onto the ground surface 104 (see FIGS. 1A-1B). The at least one optical lens 108 may be glass or plastic. The at least one optical lens 108 may be biconcave or plano-biconcave. A plurality of optical lenses 108 may allow for more light to be collected, thereby projecting a clearer image, and provide different magnification power settings. The user may manually or automatically change the magnification power to change the dimensions of the agility ladder 102. For example, the magnification power may be changed by the processor 118 based on user input received by the processor 118.

Still referring to FIG. 3A, the projection device 100 may have the plurality of sensors to detect user movement within the boundaries of the agility ladder 102. The IR laser diode 124 may be located on the projection device 100 such that the beam emitted therefrom hovers between and including 1 millimeter (mm) to 10 millimeters (mm) above the ground surface 104 (see FIGS. 1A-1B). When the user steps completely or partially within one or more enclosed zones 116 of the projected agility ladder 102 (see FIGS. 1A-1B), the IR beam is broken by the user and light is reflected back in the direction of the projection device 100. The camera 126 may captures an angle of the incoming IR light. The camera may have the IR filter 110 to block IR due to high sensitivity of cameras to IR light. The CMOS 128 may determine where the IR beam was broken. The CMOS 128 may process the captured angle of the incoming IR light to image a position of the user's appendage(s) stepping on the one or more enclosed zones 116. The VIPC 130 may determine the position of the step in real-time from where the IR light was reflected. The plurality of sensors may be capable of analyzing and determining the position of multiple steps simultaneously.

Based on the determined position of each step, the processor 118 may determine one or more of appendage ground contact time, appendage speed, number of laps completed, and stepping errors throughout the user's training session with the agility ladder 102. The ground contact time may measure the duration that the user keeps an appendage on the ground surface 104 within the one or more enclosed zones 116 for each step. The processor 118 may use one or more internal clocks to time the duration of each step. The determined ground contact time may be an average based on a ground contact time for each step. The ground contact time may be measured in milliseconds (ms), seconds (s), or minutes (m). The appendage speed may measure the speed of the user's step speed through each enclosed zone 116 or each lap (i.e., from the first enclosed zone 116 to the last enclosed zone 116). Distance may be calculated from the position of each step. Time may be kept using the one or more internal clocks of the processor 118. The appendage speed may be measured in inches per second (in/sec), feet per second (ft/sec), meters per second (m/s), and/or the like. The determined appendage speed may be an average based on average speed of progressing through each enclosed zone 116 or each lap. The number of laps completed may be determined based on the position of the user. The processor 118 may count a lap completed when the user steps on the last enclosed zone 116 of the agility ladder 102. In some embodiments, the user may define and input the conditions of a lap (e.g., returning to the first enclosed zone 116 from the last enclosed zone 116 counting as one lap).

Stepping errors may be monitored based on the user's training preferences inputted and stored in a memory 132 of the projection device 100 or the cloud. The memory 132 may be a RAM, a disk, a flash memory, an optical disk drive, hybrid memory, or any other storage medium that can store data. The memory 132 may store program code that are executable by the processor 118. The memory 132 may store data in an encrypted or any other suitable secure form.

For example, the user may select a workout in which the goal is to only step completely within one enclosed zone 116 with each step. The processor 118 may determine based on the position of each step and dimension-based boundaries of each enclosed zone 116 whether the user stepped completely within each stepped enclosed zone 116. The processor 118 may flag and count every time the user steps partially within each enclosed zone 116, skips an enclosed zone 116, and/or steps outside the agility ladder 102 based on user preference. In another example, the user may select a workout in which the goal is to step both feet one after another within an enclosed zone 116 to progress through that enclosed zone 116. The processor 118 may determine based on the position of each step and the boundaries of each enclosed zone 116 whether the user stepped both feet consecutively within an enclosed zone 116 before moving to the next enclosed zone 116. The processor 118 may flag and count every time the user steps once within an enclosed zone 116 and/or more than twice within an enclosed zone 116.

The processor 118 may begin to determine and store the metrics discussed above when user input that a workout is initiated is received. The processor 118 may pause calculation of the metrics when user input that the workout is paused is received. The processor 118 may finish calculating and storing the metrics when user input that the workout has concluded is received. In some embodiments, the processor 118 may automatically stop calculating and storing the metrics when no new user movement is detected for a predetermined time duration. For example, the user may choose for the processor 118 to automatically stop the workout after 10 minutes of no new movement detection.

The processor 118 may generate charts, graphs, tables, and/or the like based on the calculated metrics over one or more predetermined periods of time to show trends and the progress of the user over time. For example, the processor 118 may generate a presentation of calculated metrics of a given day, week, month, quarter, and/or year. The generated presentations may be stored in the memory 132 of the agility ladder 102 and/or the memory 208 of the remote device 200. The progress may be calculated and tracked based on a specific exercise, drill, or compound exercise.

The user may view the metrics and the generated presentations via an output device. The output device may be the remote device 200. In some embodiments, the output device may be a display on the housing 106 of the agility ladder 102 or connected to the agility ladder 102. The metrics may be communicated to, processed, and viewed by third-party software applications. The third-party software applications may be mobile device applications that track, monitor, and display health and fitness data of the user.

Figure 3B:
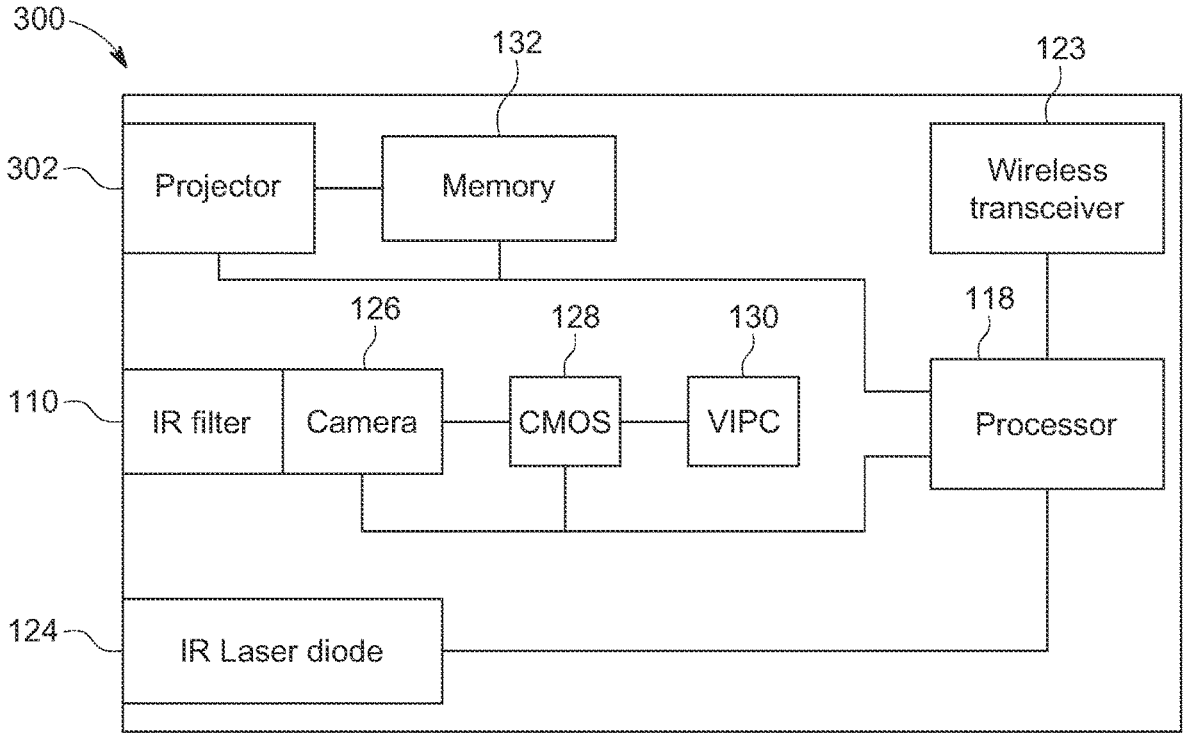
FIG. 3B is a block diagram illustrating various components of an agility ladder projection device according to an aspect of the current disclosure.

FIG. 3B is a block diagram illustrating various components of an agility ladder projection device 300 according to an aspect of the current disclosure. In the embodiment shown in FIG. 3B, the projection device 300 may have the same components of the projection device 100 of FIG. 3A except the optical lens 108, the optical element 122, and the light source 120. Instead, the projection device 300 may have a projector 302. The projector 302 may project an image of the agility ladder 102 (see FIGS. 1A-1B) stored in the memory 132 onto the ground surface 104 (see FIGS. 1A-1B) by shining a light from its lamp or bulb through its lens or directly via its lasers. The memory 132 may store a plurality of images of the agility ladder 102 having different shapes, designs, dimensions, and number of enclosed zones 116 (see FIGS. 1A-1B). The user may select a desired image of the stored plurality of images of the agility ladder 102 by an input device on the projection device 300 or the remote device 200 (see FIG. 2A). All other components shown in FIG. 3B may have the same specifications of their counterparts shown in FIG. 3A and function the same.

Figure 4:
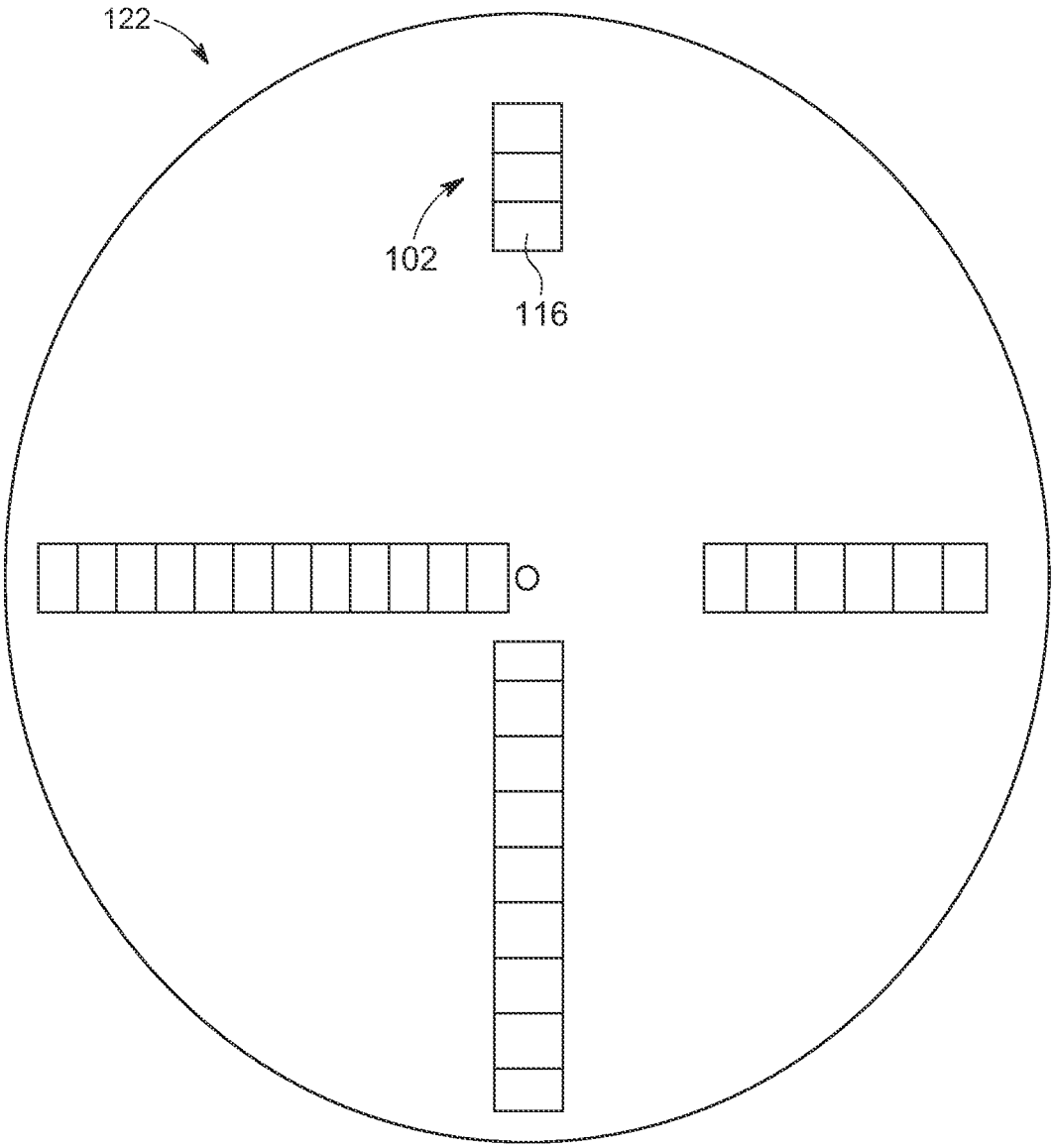
FIG. 4 illustrates a DOE of the agility ladder projection device of FIG. 3A according to an aspect of the current disclosure.

FIG. 4 illustrates an optical element 122, or a DOE by example, of the agility ladder projection device 100 according to an aspect of the current disclosure. The optical element 122 may be a reel of images of the agility ladder 102. The reel may have images of agility ladders 102 having different shapes, dimensions, and number of enclosed zones 116. By example and not limitation, FIG. 4 shows the optical element 122 having agility ladders 102 with three (3), six (6), nine (9), and twelve (12) enclosed zones 116. The reel may be manually or automatically turned to position a desired image of the agility ladder 102 to cross a direction of the light emitted from the light source 120 (see FIG. 3A). For example, the housing 106 (see FIG. 2A) may have an opening where a portion of the reel extends out and the user may turn the reel by engaging the portion with one or more fingers. In another example, the user may input a command to change the current image of the agility ladder 102 to a desired image of the agility ladder 102 and a motor attached to the optical element 122 may turn the reel to position the desired image to cross the direction of the light emitted from the light source 120. In some embodiments, in lieu of the reel, the user may insert different cartridges each having a unique image of the agility ladder 102 through the opening of the housing 106 such that the image crosses the direction of the light emitted from the light source 120.

FIG. 5A illustrates an agility ladder projection 102 having square shaped enclosed zones 116 according to an aspect of the current disclosure. The enclosed zones 116 may be adjacent. In some embodiments, the enclosed zones 116 may be spaced apart. The enclosed zones 116 may be arranged in single file. In some embodiments, the enclosed zones 116 may be side-by-side and/or offset from each other.

FIG. 5B illustrates an agility ladder projection 102 having triangle shaped enclosed zones 116 according to an aspect of the current disclosure. The enclosed zones 116 may be side-by-side and/or offset from each other. In some embodiments, the enclosed zones 116 may be arranged in single file. The enclosed zones 116 may be adjacent. In some embodiments, the enclosed zones 116 may be spaced apart.

FIG. 5C illustrates an agility ladder projection 102 having hexagon shaped enclosed zones 116 according to an aspect of the current disclosure. The enclosed zones 116 may be side-by-side and/or offset from each other. In some embodiments, the enclosed zones 116 may be arranged in single file. The enclosed zones 116 may be adjacent. In some embodiments, the enclosed zones 116 may be spaced apart.

Exemplary embodiments of the methods/systems have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A device for projecting an agility ladder onto a ground surface, the device comprising:

a light source;

an optical element configured to include an image of the agility ladder, the optical element positioned to allow the light source to project light through the optical element; and a plurality of optical lenses; the optical element positioned between the light source and at least one optical lens, wherein at least one optical lens is configured to magnify and project the image onto the ground surface to allow a user to perform agility ladder exercises;

the plurality of optical lenses configured to collect light and provide a plurality of magnification power settings;

wherein the magnification power is configured to change one or more dimensions of the agility ladder;

a housing that assembles the light source, the optical element, and the at least one optical lens;

wherein the optical element, an IR filter and a window configured to allow IR light to pass through are all disposed on a front surface of the housing; and wherein the magnification power may be changed by a processor based on user input received by the processor.

2. The device of claim 1, wherein the agility ladder has a plurality of adjacent enclosed zones, further comprising a plurality of sensors configured to detect an appendage partially or completely stepped within each of the plurality of adjacent enclosed zones and the processor coupled to the plurality of sensors, the processor programmed to determine one or more training metrics during agility ladder training.

3. The device of claim 2, wherein the plurality of sensors comprise an infrared (IR) laser diode configured to detect motion over the projected image, a camera configured to capture an incoming IR laser diode beam angle, a metal-oxide-semiconductor field-effect-transistor (MOSFET) configured to process the incoming IR laser diode beam angle to image a position of the appendage step, and a sensor configured to determine the position of the appendage step.

4. The device of claim 3, wherein the processor is further programmed to communicate with an output device to output one or more of appendage ground contact time, appendage speed, number of laps completed, and stepping errors.

5. The device of claim 4, wherein the light source is controllable by the output device.

6. The device of claim 1, wherein the agility ladder has a plurality of adjacent enclosed zones, each of the plurality of enclosed zones having a triangle, square, or hexagon shape.

7. The device of claim 1, wherein the agility ladder has a plurality of adjacent enclosed zones, further comprising a plurality of the optical elements, each of the plurality of optical elements configured to include an image of the agility ladder having a different number of each of the plurality of adjacent enclosed zones, the number being adjustable by selecting a desired one of the plurality of the optical elements to be positioned to allow the light source to project the light through the desired one of the plurality of the optical elements.

8. The device of claim 1, wherein the agility ladder has a plurality of adjacent enclosed zones, the at least one optical lens having adjustable magnification to adjust dimensions of each of the plurality of adjacent enclosed zones of the image of the agility ladder projected onto the ground surface.

9. The device of claim 1, wherein the light source is configured to emit a laser beam.

10. A projection agility ladder training system, the system comprising:

a memory configured to store an image of the agility ladder, the agility ladder has a plurality of adjacent enclosed zones;

a projector coupled to the memory, the projector configured to project the image onto a ground surface;

a plurality of optical lenses, wherein an optical element is positioned in between a light source and at least one optical lens, the at least one optical lens configured to magnify and project the image onto the ground surface to allow a user to perform agility ladder exercises;

the plurality of optical lenses configured to collect light and provide a plurality of magnification power settings;

wherein the magnification power is configured to change a plurality of dimensions of the agility ladder;

a plurality of sensors configured to detect an appendage partially or completely stepped within each of the plurality of adjacent enclosed zones;

a processor coupled to the plurality of sensors, the processor programmed to determine one or more training metrics during agility ladder training;

a housing that assembles a light source, an optical element, and at least one optical lens; and wherein the optical element, an IR filter and a window configured to allow IR light to pass through are all disposed on a front surface of the housing; and wherein the magnification power may be changed by a processor based on user input received by the processor.

11. The system of claim 10, wherein the plurality of sensors comprise an infrared (IR) laser diode configured to detect motion over the projected image, a camera configured to capture an incoming IR laser diode beam angle, a metal-oxide-semiconductor field-effect-transistor (MOSFET) configured to process the incoming IR laser diode beam angle to image a position of the appendage step, and a sensor configured to determine the position of the appendage step.

12. The system of claim 10, further comprising a user interface device comprising:

an input device configured to receive user input corresponding to a request to begin projecting the image of the agility ladder, change dimensions of each of the plurality of enclosed zones, change a number of each of the plurality of enclosed zones, change a shape of each of the plurality of enclosed zones, or stop projecting the image.

13. The system of claim 12, wherein the input device is further configured to receive user input corresponding to a request to begin, pause, or stop determining and recording the one or more training metrics, and the mobile processor is further programmed to control the plurality of sensors and the processor to execute the request based on the received user input.

14. The system of claim 10, further comprising a housing that assembles the memory, the projector, the plurality of sensors, and the processor.

15. A method for providing agility ladder training to a user, the method comprising:

producing, by a light source, light;

providing a plurality of optical lenses;

positioning an optical element between the light source and at least one optical lens, wherein at least one optical lens is configured to magnify and project an image onto a ground surface to allow a user to perform agility ladder exercises;

configuring the plurality of optical lenses to collect light and provide a plurality of magnification power settings, wherein the magnification power is configured to change a dimension of the agility ladder;

magnifying, by at least one of the optical lenses, an image of the agility ladder located on an optical element, the agility ladder comprising a plurality of adjacent enclosed zones, the optical element positioned to allow the light to pass through the optical element;

detecting, by a plurality of sensor, an appendage of the user partially or completely stepped within each square of the plurality of squares; and determining, by a processor, one or more training metrics during agility ladder training;

wherein the optical element, an IR filter and a window configured to allow IR light to pass through are all disposed on a front surface of a housing.

16. The method of claim 15, further comprising displaying, by an output device, the one or more training metrics.

17. The method of claim 15, further comprising receiving, by an input device of a user interface device, user input corresponding to a request to begin projecting the image of the agility ladder, change dimensions of each of the plurality of enclosed zones, change a number of each of the plurality of enclosed zones, change a shape of each of the plurality of enclosed zones, or stop projecting the image, and controlling, by a mobile processor of the user interface, the light source, the optical element, and the at least one optical lens to execute the request based on the received user input.

18. The method of claim 17, further comprising receiving, by the input device, user input corresponding to a request to begin, pause, or stop determining and recording the one or more training metrics, and controlling, by the mobile processor, the plurality of sensors and the processor to execute the request based on the received user input.

19. The method of claim 15, wherein the light source, the optical element, the at least one optical lens, the plurality of sensors, and the processor are assembled by a housing.

* * * * *